United States Patent [19]

Wallerstein

[11] Patent Number: 4,457,091

[45] Date of Patent: Jul. 3, 1984

[54] FIREARM SAFETY LOCK

[76] Inventor: Robert S. Wallerstein, 1888 Century Park East, Suite 1888, Los Angeles, Calif. 90067

[21] Appl. No.: 368,377

[22] Filed: Apr. 14, 1982

[51] Int. Cl.[3] ..... F41C 17/08

[52] U.S. Cl. ..... 42/1 LP; 42/70 R

[58] Field of Search ..... 42/1 LP, 70 D, 70 R; 70/278; 361/160, 171, 172; 340/825.31

[56] References Cited

U.S. PATENT DOCUMENTS 1,484,671 2/1924 Pomeroy ..... 42/70 D 3,735,519 5/1973 Fox ..... 42/1 LP 3,831,065 8/1974 Martin et al. ..... 340/825.31

4,302,898 12/1981 LaRue ..... 42/1 LP

*Primary Examiner*—Charles T. Jordan

*Attorney, Agent, or Firm*—Larson & Taylor

[57] ABSTRACT

A firearm combination safety lock is disclosed. The safety lock includes a plurality of independently actuatable members, which in the preferred embodiment, are four push button switches connected to an electronic circuit. The electronic circuit compares the sequence in which the buttons are pushed and will operate an interlock means when the sequence matches a predetermined sequence. The push buttons are preferably provided in the finger grip of the handle of the firearm.

4 Claims, 5 Drawing Figures

FIREARM SAFETY LOCK

FIELD OF THE INVENTION

The present invention relates to firearms and more particularly relates to a coded safety lock for firearms.

BACKGROUND OF THE INVENTION

Incidents relating to the inadvertent firing of firearms are numerous. Frequently, firearms are discharged while being cleaned or by children playing with the weapons. Occasionally, such weapons are also fired during the heat of an argument when rational thinking processes are impaired. There are also problems with the theft of firearms and their subsequent use in the commission of crimes.

Consequently, there is the need for a safety lock for firearms which will effectively preclude the inadvertent or unauthorized use of such weapons. On the other hand, any such safety lock must be easily and quickly released so that the weapon can be used in emergency situations.

The use of safeties or interlocks on firearms is well known and there are numerous prior art documents disclosing both mechanical and electro-mechanical interlocks. Thus, for example, the Schultz U.S. Pat. No. 4,141,166 discloses a safety mechanism for sensing the engagement of a rifle butt with an operator's shoulder and for sensing engagement of the operator's hand with the firearm stock. The sensing switches energize the solenoid which thereupon removes an interposed mechanical member. Purely mechanical interlocks are depicted in the following U.S. Pat. Nos.: Tambour—834,772 (hand grip safety); Gile—1,210,459 (rifle butt stock safety); Lepp—2,041,661 (rifle butt stock satety); Young—2,553,995 (finger-operated safety interlock); Pomeroy—1,484,671 (combination pistol magazine and special trigger safety interlock); Hempstead—1,063,921 (rifle butt stock and trigger guard safety interlock); and Atchisson—3,964,366 (trigger guard safety mechanism).

It is also known to use sequentially activated, push-button locks of both the mechanical and of the electrical type. An example of such lock of the electronic push-button type is disclosed in the U.S. Pat. No. 3,831,065 to Martin et al. The electronic lock disclosed therein is used in a door lock, but it is also known to use such a combination lock in a car ignition.

The foregoing U.S. patents are incorporated by reference in their entirety.

SUMMARY OF THE INVENTION

In accordance with the invention, there is provided an easily operable firearm combination safety lock. The safety lock is incorporated in a firearm having a handle, a barrel connected to the handle, and a firing mechanism and includes a plurality of independently actuatable members and a means for determining the sequence of actuation of those members. The safety device further includes an interlock means operated by the determining means only after the members are actuated in a proper sequence. The interlock means prevents the operation of the firing mechanism, and hence of the firearm, unless the interlock means in turn has been operated by the determining means.

A safety lock according to the present invention is particularly adapted to firearms of the handgun type. However, the present invention can also be used in rifles, shotguns, and other similar, hand-held firearms. Obviously, the safety lock can be quickly operated by a person who knows the code to place the firearm in an operable condition. On the other hand, such a safety lock prevents inadvertent operation of the firearm by children, by unauthorized persons, and in some cases by persons knowing the combination, but who are momentarily mentally impeded, such as by intense anger or intoxication. Obviously, such a safety lock permits operation of a firearm only when the user intends such operation.

Other features and objects of the present invention will be set forth in, or apparent from, the accompanying drawings and detailed description of the preferred embodiment found hereinbelow.

DETAILED DESCRIPTION OF THE PREFERRED EMBODIMENTS

Figure 1:
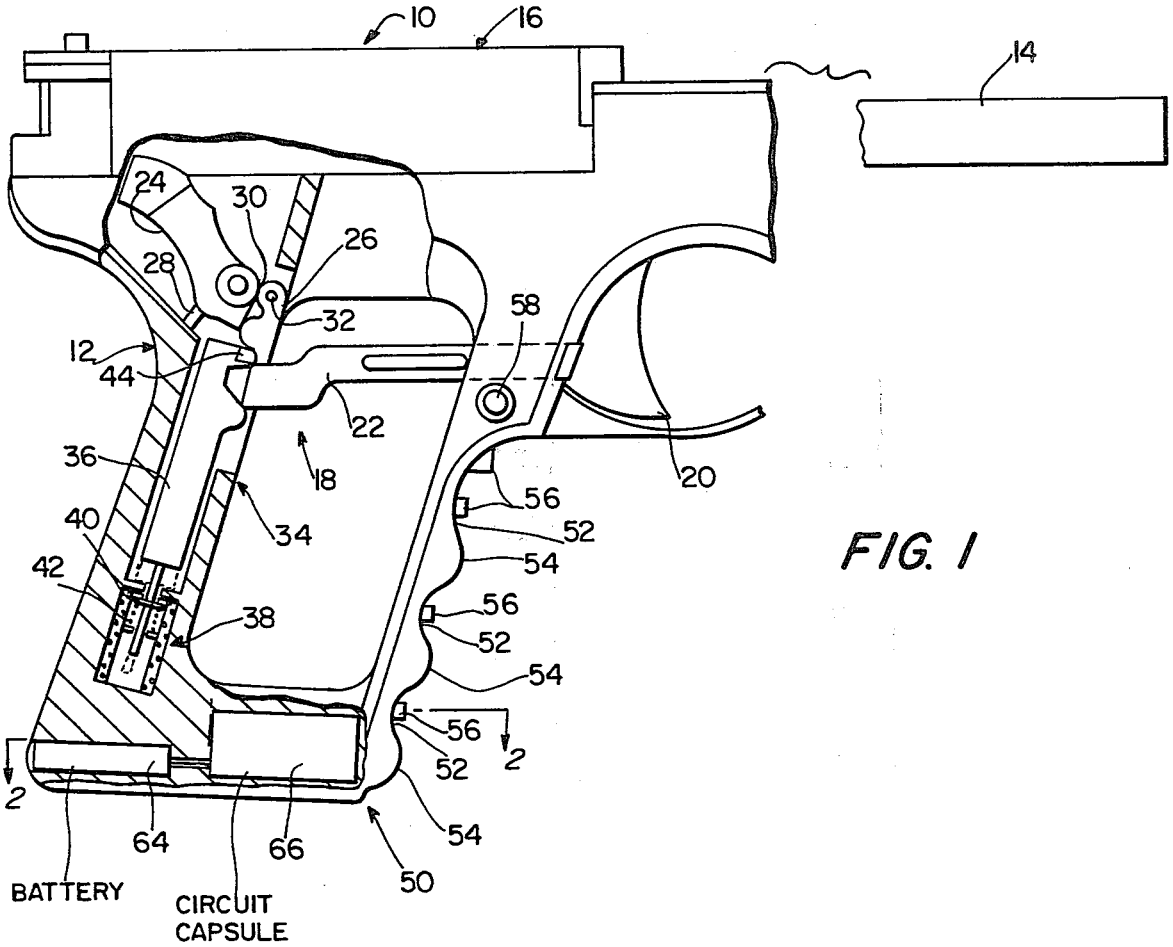
FIG. 1 is a side elevational view of a handgun firearm according to the present invention with parts removed and a portion thereof being shown in cross-section.

Reference now is made to the drawings in which like numerals represent like elements throughout the several views. In FIG. 1, part of a hand gun 10 incorporating the present invention is depicted. Initially, however, it is noted that the present invention can be used with any type of firearm, including handguns, rifles, and shotguns. Furthermore, handgun 10 depicted in FIG. 1 is essentially a modified, conventional handgun depicted in greater detail in Pomeroy U.S. Pat. No. 1,484,671.

Handgun 10 is comprised of a handle portion 12 and a barrel portion 14 operatively connected to handle portion 12. A conventional breech closure 16 is mounted between barrel portion 14 and handle portion 12.

Handgun 10 also includes a firing mechanism 18 comprised of a trigger 10 slidably mounted in handle portion 12, a trigger bar 22 connected to trigger 20 and also slidably mounted in handle portion 12, a hammer 24 and a sear 26. Hammer 24 is shown in the retracted position, preparatory to firing and is biased in the forward direction by a hammer spring 28. A spring-pressed plunger (not shown) engages a lug 30 on sear 26 urging sear 26 in a counterclockwise direction about pivot 32. When hammer 24 is cocked, a shoulder (not shown) on sear 26 rests on a shoulder (also not shown) mounted on handle portion 12 with the spring-pressed plunger holding sear 26 in this position.

A safety interlock mechanism 34 comprises a safety bar 36 vertically slidable between an uppermost position as shown in FIG. 1 and a lowermost position shown in dashed lines. A solenoid 38 having a push rod 40 biased by a spring 42 in the upward direction is located below safety bar 36. Safety bar 36 is also spring biased in the downward direction by a spring (not shown) that is weaker than solenoid spring 42. When energized, solenoid 38 retracts push rod 40 against the spring pressure allowing safety bar 36 to be moved in the downward direction. Safety bar 36 has a lug 44 which engages with sear 26 when in the upward direction preventing the clockwise pivot of sear 26 about sear pivot 32. When safety bar 36 is in its lowermost position, lug 44 is disengaged from sear 26 permitting sear 26 to be pivoted by trigger bar 22 when trigger 20 is depressed.

In operation, handgun 10 is cocked by moving breech closure 16 in the rearward direction in a conventional manner. This locks hammer 24 in its cocked position as shown in FIG. 1. When solenoid 38 is energized (as discussed hereinbelow), push rod 40 is moved downward thereby allowing the safety bar spring to push safety bar 36 to the lowermost position. Lug 44 is then removed from sear 26. When trigger 20 is pulled, trigger bar 22 is moved in the rearward direction pivoting sear 26 in the clockwise direction. This disengages the sear lug from the hammer lug permitting hammer 24 to be rapidly rotated in the clockwise direction and fire handgun 10 in the conventional manner.

Figure 5:
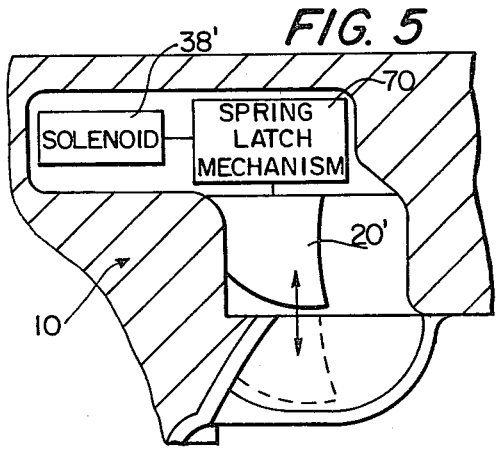
FIG. 5 is a schematic representation, partially in block form, of a further embodiment of the invention wherein the interlock is used to control release of the trigger from a recessed position within the handgun.

It should be obvious that safety mechanism 34 can also by physically held in its uppermost position by mechanical interlocks. One such interlock could be the proper positioning of a magazine 46 (FIG. 2) in handle portion 12. Another such interlock could be the standard mechanical safety used on most firearms. Further, in an important embodiment illustrated in FIG. 5, the interlock is used to provide that the trigger, indicated at 20', is propelled from an inoperative, e.g., recessed, position in the gun (shown in solid lines in FIG. 5) to a normal operating position for firing of the gun (shown in dashed lines), when the solenoid, indicated at 38', is energized. This can be accomplished, for example, by using the solenoid 38' to control release of a spring latch mechanism 70 for moving a trigger assembly 20' recessed in the gun above the trigger guard (or as a complete unit including the guard) to the firing position thereof.

As mentioned above, the present invention has been described with respect to a specific safety mechanism for a specific handgun 10. However, the present invention can be incorporated into any type of firearm and operate on any type of interlock mechanism depending upon the type of firearm firing mechanism. In the embodiment of FIG. 1, safety mechanism 34 prevents the operation of sear 26. Other mechanical interlocks could be provided, for example, to prevent the rearward positioning of trigger 20, the cocking action of breech closure 16, the rotation of hammer 24, or the positioning of a firing pin. Such interlocks are disclosed in the aforementioned U.S. patents.

Handle portion 12 is also provided with a hand grip 50 having three notches 52 defined by three rounded ridges 54. A resiliently mounted push button 56 is located in each of the notches 52 with an additional push button 56 also being located in the uppermost notch 52. A reset button 58 is located just above the uppermost push button 56 behind trigger 20.

Figure 2:
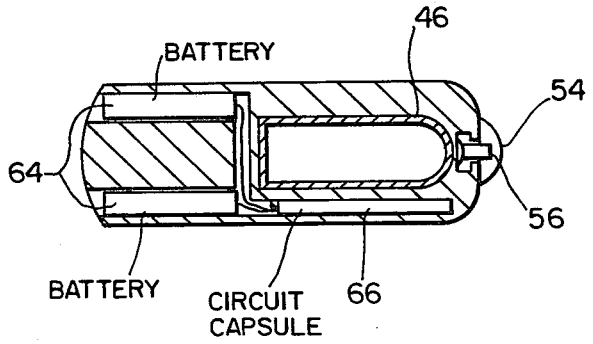
FIG. 2 is a cross-sectional view taken along lines 2—2 of FIG. 1.
Figure 3:
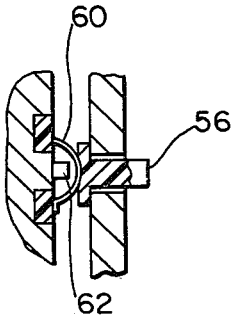
FIG. 3 is an enlarged view of part of FIG. 2.

With reference to FIGS. 2 and 3, push button 56 is preferably made of plastic or an insulating material so as not to be affected by outside electrical potentials. Push button 56 is held in outermost position by a leaf spring 60 positioned over an electrical contact 62. Thus, when push button 56 is pushed against the spring pressure of spring 60, spring 60 comes into contact with electrical contact 62. Preferably leaf spring 60 is made of a conductor, such as copper, aluminum, or steel, and completes the electrical connection when positioned in contact with electrical contact 62. Reset push button 58 is similarly mounted in handle portion 12. The four push buttons 56 form one element of four switches 101, 102, 103 and 104, which are described in greater detail hereinbelow.

Referring in particular to FIG. 2, also shown being mounted in handle portion 12 are two conventional batteries 64 and an electronic circuit capsule 66. Circuit capsule 66 is electrically connected to battery 64 and to switches 101 through 104 (see FIG. 4) as well as a switch 110 of which reset button 58 is a component.

Figure 4:
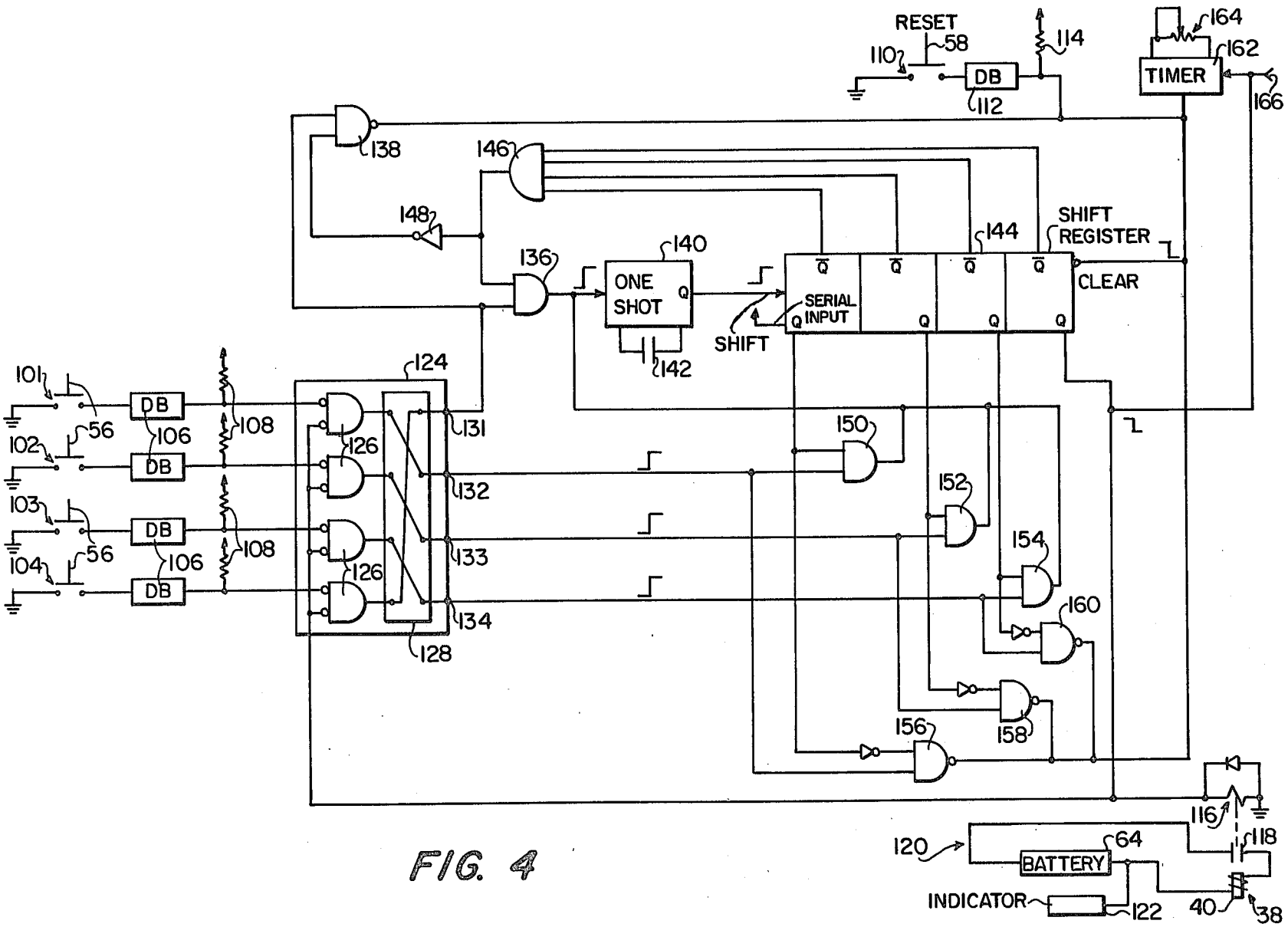
FIG. 4 is an electrical schematic diagram of a circuit usable for determining whether the correct sequence of buttons have been pushed and for operating an interlock.

The electronic circuitry contained inside circuit capsule 66 is any particular circuit which can determine whether the sequence in which push buttons 56 are actuated is in accordance with a predetermined sequence. One such electrical circuit is depicted in FIG. 4 and another such electrical circuit whose modification would be obvious to one of ordinary skill in the art is depicted in the aforementioned Martin et al U.S. Pat. No. 3,831,065.

With particular reference now to FIG. 4, four switches, 101, 102, 103 and 104 are each connected between ground and a corresponding, conventional debouncing circuit 106. The output from each debouncing circuit 106 is held high by a pull up resistor 108. A reset switch 110 is similarly connected between ground and a debouncing circuit 112 and pull up resistor 114. Switches 101 through 104 and reset switch 110 represent the inputs to the electronic circuit. The output of the electronic circuit is a relay 116 which operates a contact 118 in a solenoid circuit 120. The other components of solenoid circuit 120 is the aforementioned solenoid 38 and batteries 64. In addition, an indicator 122, which can be an audible and/or visual indication of when solenoid 40 is energized is provided. Of course, such an indicator would be unnecessary in the embodiment described above wherein the trigger is caused to move to the firing position when the solenoid is actuated.

The signals from switches 101 through 104 are received by a coding unit 124 having enabled inputs. The inputs are enabled through individual NOR gates 126, which for convention are depicted as AND gates active with a low or zero ("0") input. In this way, coding unit 124 can be disabled whenever it is desired to lock out the inputs from switches 101 through 104. The outputs from gates 126 are coupled to a coder 128. Coder 128 can be any programmable unit which can selectively, in a predetermined manner, couple the inputs of coding unit 124 to selected outputs thereeof. In FIG. 4, coder 128 is depicted as a simple, hard wired terminal post having four input terminals and four output terminals. The output terminals of coder 128 are connected to the four individual outputs 131 through 134 of coding unit 124.

Thus, as described hereinabove, it can be seen that the circuit of FIG. 4 provides a means for selectively predetermining the desired sequence of input switches 101 through 104 in order to achieve successive outputs at terminals 131 through 134. In this way, a separate code can be set for each firearm. In addition, although only four input switches are depicted and each input switch provides a particular output, it should be obvious that more than four input switches could be utilized to provide more than four outputs from coding unit 124, or that four active switches can be provided with any number of inactive or dummy switches. In this way, a greater number of different codes can be provided.

Output 131 from coding unit 124 is connected to an enable AND gate 136 and one input of a reset NAND gate 138. The output of enable gate 136 is connected to the input of a monostable multivibrator or one shot 140. Preferably, one shot 140 is a non-retriggerable multivibrator such as a conventional 74121 TTL circuit. The purpose of one shot 140 is to provide a standard pulse having a predetermined pulse width according to an attached capacitor 142. The Q output of one shot 140 is connected to the shift or clock input of a serial in, parallel out, four stage shift register 144. Shift register 144 has a Clear input which will override any other input to reset each of the individual stages. In addition, shift register 144 has both Q and Q-not outputs. One commercially available shift register usable in the present electronic circuit is TTL circuit 7496. It is noted that pull up resistor 114 and the output from debouncing circuit 112 is connected to the Clear input of shift register 144. It is also noted that the serial input is tied high so that 1's are loaded into shift register 144 when the Clock input is triggered.

Each of the Q-not outputs of shift register 144 is connected to a four-input AND gate 146. The true output from gate 146 is connected to the enable input of enable AND gate 136. Thus, when shift register 144 has been cleared, there will be all one's at the Q-not outputs, which in turn produces a one output at gate 146 and enables enable AND gate 136. The false output from gate 146, provided by an inverter 148 is fed to the enable input of reset gate 138. The output of reset gate 138 is connected to the Clear input of shift register 144. Thus, coding unit output 131 is coupled to one shot 142 and thus to shift register 144 only when enable gate 136 is enabled. If enable gate 136 is not enabled, then reset gate 138 will be enabled. In operation, this means that if the first push button to be pushed, which in this example is the one connected to switch 104, is pushed either any time other than the first time or pushed twice, shift register 144 will be cleared.

A set of three AND gates 150, 152, and 154 are respectively connected to the first, second and third stages of shift register 144. The other input to these AND gates is connected to coding unit outputs 132 through 134, respectively. The outputs from all of the three AND gates 150, 152 and 154 are connected to the input of one shot 140. Thus, each AND gate 150, 152 and 154 is enabled in turn by the proper actuation of the previous switch 101 through 103, and then when its corresponding switch is activated produces an output that causes shift register 144 to be clocked one time and to input a "1" into the first stage.

A second set of gates 156, 158 and 160, which are NAND gates, are connected to either the Q-not output of shift register 144, or as shown in FIG. 4 to the Q output through an inverter. The other input of these gates is connected, respectively, to coding unit outputs 132 through 134. The outputs from gates 156, 158 and 160 are all connected to the Clear input of shift register 144. In this way, whenever the output from coding unit 124 is not in the proper sequence, the particular one of AND gates 150, 152 and 154 will not have been enabled, but the other corresponding one of NAND gates 156, 158 and 160 will have been enabled. The result is that shift register 144 is cleared on any improper sequencing of the corresponding switches.

The last stage of shift register 144 is connected to relay 116 and also connected to the enable inputs of NOR gates 126. In this way, when the proper sequence of switches 101 through 104 has been completed (which in example 4 the sequence is 104, 101, 102 and 103), relay 116 will have been actuated and NOR gates 126 will have been disabled.

The output from the last stage of shift register 114 is also connected to the input of a retriggerable timer 162. Preferably, timer 162 has a variable delay which can be set by a rheostat 164. Another input to timer 162 is provided at 166. For example, once handgun 10 has been enabled, it can be fired as many times without reactivating the sequence of switches 101 through 104 until timer 162 times out. However, if upon each firing of handgun 10, means is provided to retrigger timer 162, e.g., by sear 26 activating a momentary contact when it has been rotated by trigger 20, then handgun 10 can be continuously fired for an indefinite time so long as there is one firing within the preset timing period. When timer 162 has timed out, it provides a pulse to the Clear input of shift register 144. Then, if handgun 10 is to be fired again, the proper sequence of actuating switches 101 through 104 must be conducted again.

In operation, a user desiring to fire handgun 10 will position breech closure 16 to cock hammer 24. The user will then actuate switches 104, 101, 102 and 103, in that order, to cause solenoid 38 to be energized and push rod 40 to be withdrawn from engagement with safety bar 36. Safety bar 36 is then depressed by its spring to unlock sear 26 and permit it to be rotated upon the depression of trigger 20. If trigger 20 is not depressed before timer 162 has timed out, then solenoid 38 will be deenergized, and push rod 40 urged upwardly by spring 42 to reposition safety bar 36 into a blocking position with sear 26.

When switch 104 is actuated first, the debounced output will be provided to the enabled input of NOR gate 126. These gates have been enabled because shift register 144 has been cleared and the Q output of the fourth stage thereof provides a low or zero output. The output from coding unit 124 appears at output 131 and is transmitted through the enabled AND gate 136 to trigger one shot 140. Gate 136 has been enabled because all stages of shift register 144 have a high or one output at the Q-not outputs. One shot 140 thereupon provides a pulse to the shift input of shift register 144. Since the serial input to shift register 144 has been tied high, a one is shifted into the first stage. This one appears at the Q output of the first stage and enables gate 150 and disables gate 156. In addition, four input AND gate 146 is now disabled preventing a second pulse from being delivered to one shot 140 should switch 104 be actuated again.

When switch 101 is actuated, the debounced input is provided through enabled gate 126 and coding unit output 132 to the other input of enabled AND gate 150. AND gate 150 now delivers an output to trigger one shot 140 which in turn causes shift register to shift another one into the serial input. This provides a one in the first and second stages.

When a one is shifted to the second input of shift register 144, gate 152 is enabled and gate 158 is disabled. Similarly, when switch 102 is actuated, shift register 144 will have another one clocked in so that ones will appear in the first three stages. This results in gate 154 being enabled and gate 160 being disabled. Finally, when switch 103 is actuated, the pulse will be delivered through gate 154 and shift register 144 will shift another one into its input. This provides a one in each of the four stages of shift register 144. As mentioned above, timer 162 will be actuated, relay 116 energized and solenoid 40 energized and NOR gates 126 disabled.

Now suppose that after actuation of switch 104, switch 103 is next actuated. A one will have been shifted into only the first stage of shift register 144 and gate 154 will still be disabled because the third stage of shift register 144 still has a zero in it. However, when gate 154 is disabled, gate 160 is enabled and when switch 103 is depressed, an output will appear at coding unit output 134 and will cause an output to be produced at NAND gate 160. This output in turn causes shift register 144 to be reset.

It would also be obvious to those of ordinary skill in the art to provide other features for the circuit depicted in FIG. 4. Thus, for example, it would be possible to completely lock out the circuit for an extended period of time after a predetermined number of incorrect attempts. This could easily be done by counting the number of clear pulses to shift register 144 and then, through a timer, disabling NOR gates 126. In addition, should a user desire to disable the circuit for a period of time, reset switch 110 can be locked in place to keep shift register 144 cleared. Alternatively, a power control switch could be provided to keep solenoid circuit 120 de-energized.

Although the means for determining whether the sequence of switches 101 through 104 are actuated in the predetermined sequence has been disclosed as an electronic circuit, conventional mechanical switches are also available and could be provided. Furthermore, it is possible instead of having four monopolar switches to have two binary switches and to use them to cause a binary input to be entered.

Although the invention has been described in detail with respect to exemplary embodiments thereof, it will be understood by those of ordinary skill in the art that variations and modifications may be effected within the scope and spirit of the invention.

I claim:

1. In a firearm including a handle, a barrel connected to the handle, and a firing mechanism, a safety device comprising:

a plurality of independently actuatable members;

electronic circuit means for determining whether the sequence in which said members are actuated is a predetermined sequence; and interlock means, operated by said determining means only when said members are actuated in said predetermined sequence, for preventing the operation of said firing mechanism, and hence of said firearm, unless said members are so actuated, said actuatable members comprising at least three electrical switches; the handle of said firearm including a finger grip; and said firearm further comprising mounting means for mounting said switches in said finger grip of said handle.

2. A firearm as claimed in claim 1 wherein said electrical switches are push buttons.

3. In a firearm including a handle, a barrel connected to the handle, and a firing mechanism, a safety device comprising:

a plurality of independently actuatable members;

electronic circuit means for determining whether the sequence in which said members are actuated is a predetermined sequence; and interlock means operated by said determining means only when said members are actuated in said predetermined sequence for preventing the operation of said firing mechanism, and hence of said firearm, unless said members are so actuated, said firing mechanism including a trigger which is movable between an inoperative position wherein the firearm cannot be fired and an operative position wherein said firearm can be fired, and said interlock means controlling the movement of said trigger between said inoperative and operative positions, said trigger being recessed into the firearm in the inoperative position thereof.

4. In a firearm including a handle, a barrel connected to the handle, and a firing mechanism, a safety device comprising:

a plurality of independently actuatable members;

means for determining whether the sequence in which said members are actuated is a predetermined sequence; and interlock means, operated by said predetermined sequence, for preventing the operation of said firing mechanism, and hence of said firearm, unless said members are so actuated, said actuatable members comprising at least three push buttons; the handle of said firearm including a finger grip; and said firearm further comprising mounting means for mounting said push buttons in said finger grip of said handle.

* * * * *